US010233622B2

(12) United States Patent
Ball et al.

(10) Patent No.: US 10,233,622 B2
(45) Date of Patent: Mar. 19, 2019

(54) WASTEWATER DRAIN STOPPER SYSTEM

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM INDUSTRIES, INC., Colorado Springs, CO (US)

( * ) Notice: Subject to any disclaimer, the term of this patent is extended or adjusted under 35 U.S.C. 154(b) by 110 days.

(21) Appl. No.: 15/171,642

(22) Filed: Jun. 2, 2016

(65) Prior Publication Data

US 2016/0356028 A1 Dec. 8, 2016

Related U.S. Application Data

(60) Provisional application No. 62/171,656, filed on Jun. 5, 2015.

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/2302
See application file for complete search history.

(56) References Cited

U.S. PATENT DOCUMENTS

| | | | | | |
|---|---|---|---|---|---|
| 773,408 | A | | 10/1904 | Moore | |
| 1,647,188 | A | | 11/1927 | Mueller et al. | |
| 1,980,250 | A | | 11/1934 | Baxter | |
| 2,179,121 | A | | 11/1939 | Frank et al. | |
| 2,486,246 | A | | 10/1949 | Beeke | |
| 2,807,806 | A | | 10/1957 | Watkins | |
| 2,827,639 | A | | 3/1958 | Schmidt | |
| 3,002,196 | A | | 10/1961 | Mackey, Jr. | |
| 3,010,118 | A | * | 11/1961 | Isherwood | E03C 1/23 4/688 |
| 3,314,083 | A | * | 4/1967 | Minella | E03C 1/23 4/287 |
| 3,314,085 | A | * | 4/1967 | Minella | E03C 1/23 4/287 |
| 4,192,026 | A | | 3/1980 | Williams | |
| 4,577,349 | A | | 3/1986 | Clegg | |
| 4,596,057 | A | | 6/1986 | Ohta et al. | |
| 4,807,306 | A | | 2/1989 | Hayman et al. | |
| 5,050,247 | A | * | 9/1991 | Hsu | E03C 1/23 4/292 |
| 5,208,921 | A | | 5/1993 | Nicoll | |
| 5,363,519 | A | | 11/1994 | Husting | |
| 5,640,724 | A | | 6/1997 | Holmes | |
| 5,749,561 | A | | 5/1998 | Worthington | |
| 5,787,521 | A | | 8/1998 | O'Connell et al. | |
| 5,822,812 | A | | 10/1998 | Worthington et al. | |
| 6,138,297 | A | * | 10/2000 | Harris | E03C 1/23 4/689 |

(Continued)

*Primary Examiner* — Janie Loeppke

(57) ABSTRACT

A wastewater drain assembly is provided that includes a selectively openable drain stopper. The wastewater drain assembly is interconnected to a fluid basin wherein a flange, which is interconnected to wastewater plumbing, is situated within the sink. The flange receives an insert that has a portion that conceals the flange.

20 Claims, 11 Drawing Sheets

(56) References Cited

U.S. PATENT DOCUMENTS

| | | | | |
|---|---|---|---|---|
| 6,154,898 | A * | 12/2000 | Ball | E03C 1/232 4/286 |
| 6,219,861 | B1 | 4/2001 | Chen | |
| 6,282,730 | B1 * | 9/2001 | Duncan | A47K 1/14 251/65 |
| 6,308,351 | B1 | 10/2001 | Franke | |
| 6,367,102 | B1 | 4/2002 | McMullen | |
| 6,470,514 | B2 | 10/2002 | Onoue | |
| 6,484,330 | B2 | 11/2002 | Gray et al. | |
| 6,973,685 | B2 | 12/2005 | Duncan | |
| 7,503,083 | B2 | 3/2009 | Ball | |
| 8,607,376 | B2 * | 12/2013 | Ball | E03C 1/22 285/332.2 |
| 9,015,870 | B2 | 4/2015 | Ball | |
| 9,015,876 | B2 | 4/2015 | Ball | |
| 2003/0041374 | A1 | 3/2003 | Franke | |
| 2006/0179564 | A1 | 8/2006 | Jacobs | |
| 2009/0151060 | A1 | 6/2009 | Zubillaga et al. | |
| 2009/0172877 | A1 | 7/2009 | Ball | |
| 2009/0255041 | A1 | 10/2009 | Duncan | |
| 2010/0154114 | A1 | 6/2010 | Van Zeeland et al. | |

* cited by examiner

WASTEWATER DRAIN STOPPER SYSTEM

This application claims the benefit of U.S. Provisional Patent Application Ser. No. 62/171,656, filed Jun. 5, 2015, the entirety of which is incorporated by reference herein.

This application is also related to U.S. Pat. Nos. 6,154,898, 7,503,083, 8,607,376, 9,015,870, and 9,015,876, the entire disclosures of which are incorporated by reference herein.

FIELD OF THE INVENTION

Embodiments of the present invention are generally related to sink drain closures. More specifically, some embodiments of the present invention are directed to selectively closable stoppers used in sinks or other fluid basins.

BACKGROUND OF THE INVENTION

Sink drain closures are sometimes comprised of a selectively movable drain stopper that has a first portion used to seal the drain and a second portion operatively interconnected to a mechanism that facilitates movement of the drain stopper. An example of a common sink drain closure is shown in FIG. 1. FIG. 1 shows a sink 2 with interconnected to a wastewater drain system 6 of a dwelling. The wastewater drain system 6 is interconnected to a body 10 that is held to the sink 2 with a flange 14. The body 10 includes a threaded portion 18 that selectively receives the flange 14, wherein the body 10 is secured to the sink 2 with the seal 22 and nut 26 engaged to the threaded portion 18, and abutted against an outer surface of the sink 2. In other versions, the flange 14 is integrated to the body 10.

As shown in FIG. 1, a drain stopper 30 is placed within the body 10. Operation of the drain stopper 30 to control fluid flow from the sink is achieved by providing a ball rod 34 that is inserted into the body 10. A first end 38 of the ball rod 34 interfaces with the second portion 40 of the drain stopper 30 such that when the ball rod 34 is rotated about a ball 42 seated in the body 10, the drain stopper 30 will move. As those of ordinary skill in the art will appreciate, movement of the ball rod 34 is achieved by movement of a link 46 interconnected to a second end 50 of the ball rod with a clip 54.

Common sink drain closures are expensive to manufacture and/or to install, and tend to experience decreased functionality after long-term use. They are also not easily cleaned or accessible for repair and replacement.

Thus it is a long felt need to provide a sink drain closure that is easy to install and replace. The following disclosure describes an improved sink drain stopper adapted for interconnection to a sink and which includes an insert that allows for selective alteration of the aesthetic appearance of the sink.

SUMMARY OF THE INVENTION

It is one aspect of embodiments of the present invention to provide a sink drain closure that is inexpensive to manufacture and highly efficient to use and operate. It is another aspect to provide a sink drain closure that provides enhanced access to valve closure elements. That is, embodiments of the present invention include easily-removable parts that allow access to a fluid control valve positioned within the wastewater plumbing found below the sink.

More specifically, the fluid control valve comprises a drain stopper with a diameter greater than that of an opening in a valve seat integrated into the body. The drain stopper is, thus, adapted to close the opening to fluid flow. The valve element is interconnected to a valve stem that extends downwardly through the opening in the valve seat. A lower end of the valve stem is connected to a ball rod used to selectively move the drain stopper and open/close the fluid control valve.

Some embodiments also provide a strainer element that extends across a port in the bottom of the sink to prevent large particulate matter to enter the wastewater plumbing. The strainer of one embodiment is incorporated into an insert selectively interconnected to a flange that connects the sink to the wastewater plumbing. Strainers of some embodiments of the present invention include a plurality of holes. The holes are large enough to allow water therethrough, but are designed to prevent hair, Q-tips, wedding rings, etc. from entering into the wastewater plumbing.

It is another aspect of some embodiments of the present invention to provide a drain stopper that is concealed within the wastewater drain plumbing. For example, some embodiments employ a valve seat associated with the internal surface of the wastewater drain pipe. The valve seat selectively receives a drain stopper that is moved in the same or similar fashion as prior art systems. Here, however, the drain stopper and associated seal interact with the seat and is completely concealed from the user. Accordingly, this aspect of the present invention eliminates the unaesthetic qualities of prior art drain stoppers, e.g., they do not sit flush with the bottom surface of the sink when opened. Stated differently, the prior art drain stoppers when an open configuration, provide an unsightly, loose-fitting appearance.

It is yet another aspect of some embodiments the present invention to provide a sink drain closure system that is easy to replace or repair. Those of ordinary skill in the art will appreciate that if the prior art drain stoppers become damaged, or if the homeowner wishes to change the aesthetic appearance of the sink fixtures, the drain stopper and associated strainer must be replaced. For example, changing the sink flange (i.e., the flange associated with a strainer) from chrome to a brushed-nickel finish would be a time-consuming and expensive task. Conversely, embodiments of the present invention are easily repaired by simply replacing an insert selectively interconnected to the sink flange. Again, only the insert would need to be replaced as the drain stopper and associated components are completely concealed. Indeed, the shape, color, form, etc. of the drain stopper is irrelevant in some instances as it is never visible during use. Thus some embodiments of the present invention avoid the expense associated with manufacturing an aesthetically pleasing drain stopper, e.g., one made of chrome.

It is still yet another aspect of embodiments of the present invention to provide a drain stopper that provides a tight seal. More specifically, the drain stoppers of the prior art employ a seal that interfaces with an inner surface of the strainer. Thus, the drain stopper seal must be dimensioned such that it easily fits within the sink strainer, which often renders the drain stopper seal ineffective. Conversely, embodiments of the present invention employ a seal that tightly engages a seat position in the drain plumbing, thereby providing an enhanced seal that prevents water from exiting the sink.

Thus it is one aspect of the present invention to provide a wastewater drain system, comprising: a body having a first, threaded end and a second end adapted for interconnection to wastewater drain pipes of a structure, the body having an opening for receipt of a ball rod; a flange interconnected to the first end of the body; a seal positioned about the body; a nut positioned about the body, the nut and the seal adapted to be abutted against an exterior of a fluid receptacle, wherein the flange is abutted against an interior of the fluid receptacle, and wherein the body is secured to the fluid receptacle by the flange and the nut; a stem having a proximal end and a distal end, the distal end operatively interconnected to an end of the ball rod, wherein the proximal end includes a stopper; an insert selectively interconnected to the flange; and wherein the stem can be moved with the ball rod from a first position of use to engage the stopper against a seat positioned in the body to prevent fluid flow through the wastewater drain system, and a second position of use that separates the stopper from the seat to allow fluid flow through the wastewater drain system.

Thus it is another aspect of the present invention to provide a wastewater drain system interconnected to a sink drain port, comprising: a body having a first, threaded end and a second end adapted for interconnection to wastewater drain pipes of a structure, the body having an opening for receipt of a ball rod; a stem having a proximal end and a distal end, the distal end operatively interconnected to an end of the ball rod, wherein the proximal end includes a stopper; and an insert associated with the drain port and selectively interconnected to the body.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
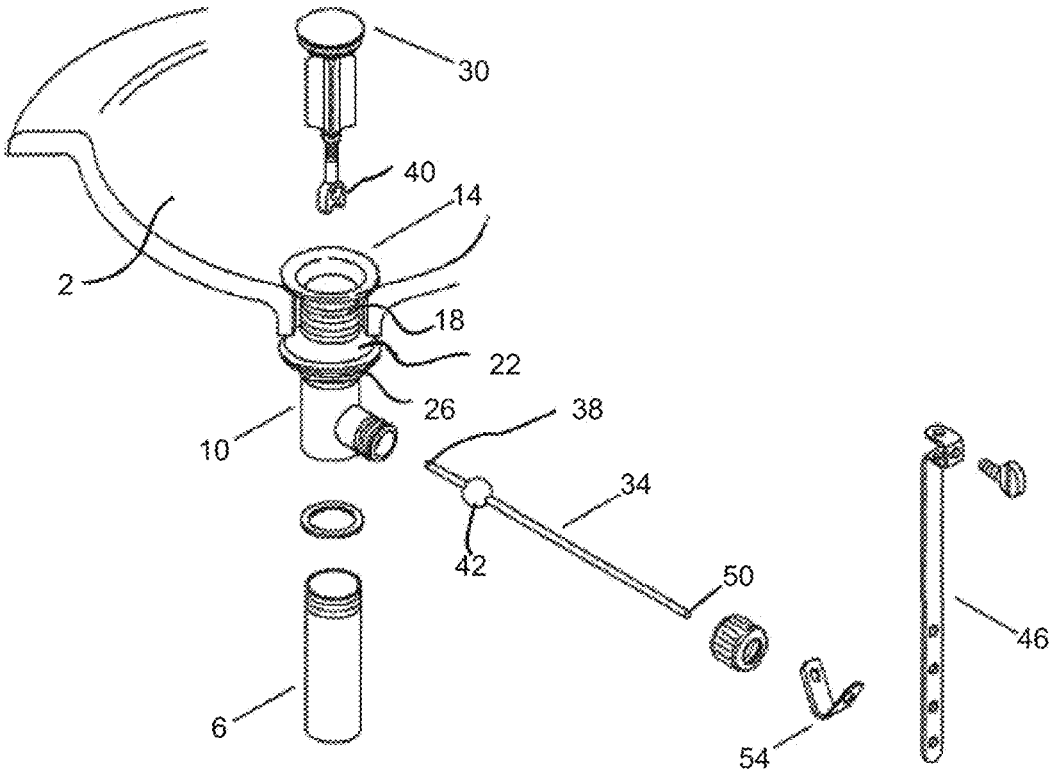
FIG. 1 (Prior Art)
FIG. 1 is a partial perspective view of a common wastewater drain system.

To assist in the understanding of one embodiment of the present invention the following list of components and associated numbering found in the drawings is provided herein:

| # | Component |
|---|---|
| 2 | Sink |
| 6 | Wastewater drain system |
| 10 | Body |
| 14 | Sink flange |
| 18 | Threaded portion |
| 22 | Seal |
| 26 | Nut |
| 30 | Drain stopper |
| 34 | Ball rod |
| 38 | First end |
| 40 | Second portion |
| 42 | Ball |
| 46 | Link |
| 50 | Second end |
| 54 | Clip |
| 110 | Body |
| 114 | Sink flange |
| 118 | Threaded portion |
| 122 | Seal |
| 126 | Nut |
| 130 | Drain stopper |
| 132 | Nut |
| 134 | Ball rod |
| 140 | Distal end |
| 142 | Ball |
| 146 | Link |
| 154 | Clip |
| 158 | Rod |
| 162 | Thumbscrew |
| 166 | Knob |
| 170 | Valve stem |
| 174 | Seat |
| 180 | Insert |
| 184 | Upper seal |
| 188 | Holes |
| 192 | Seal |
| 194 | Insert wall |
| 196 | Inner surface |
| 197 | Lower surface |
| 198 | Shoulder |
| 200 | Lower surface |
| 204 | Shoulder |
| 206 | Flange wall |
| 207 | Groove |
| 208 | Boss |
| 209 | Recess |
| 210 | Body |
| 214 | Sink flange |
| 222 | Seal |
| 226 | Nut |
| 230 | Drain stopper |
| 270 | Valve stem |
| 274 | Seat |
| 280 | Insert |
| 310 | Body |
| 314 | Sink flange |

-continued

| # | Component |
|---|---|
| 326 | Nut |
| 330 | Drain stopper |
| 332 | Seal |
| 334 | Ball rod |
| 340 | Distal end |
| 342 | Threaded portion |
| 343 | Opening |
| 370 | Valve stem |
| 380 | Insert |
| 382 | Hub |
| 386 | Drain stopper seal |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIGS. 2-5 show a drain closure system of one embodiment of the present invention. The drain closure system is comprised of a body 110 having a threaded portion 118 that terminates at a sink flange 114. As those of ordinary skill in the art will appreciate, the body of this and other embodiments of the present invention described herein may be made of multiple pieces. The body 110 also receives a nut 132 that secures a ball rod 134, wherein a portion of the ball rod 134 is positioned within the body 110. The body 110 is interconnected to the sink, wherein the flange 114 is in contact with a lower surface of sink. Next, a nut 126 and associated seal 122 are interface with a threaded portion 118 of the body 110 and tighten against a lower outer surface of the sink to secure the body 110 to the sink. After the body 110 is secured to the sink, it is also interconnected to the wastewater drain plumbing of the dwelling. The ball rod 134 is interconnected to a link 146 via a clip 154, or other device. The link 146 is secured to a rod 158 with a thumbscrew 162, or other device. The rod terminates at a knob 166, wherein movement of the rod 166 will selectively move the ball rod 134 and, thus, a portion of the ball rod 134 positioned within the body 110. The interconnection between the ball rod 134 and the body 110 should be well known by those of ordinary skill in the art.

Figure 3:
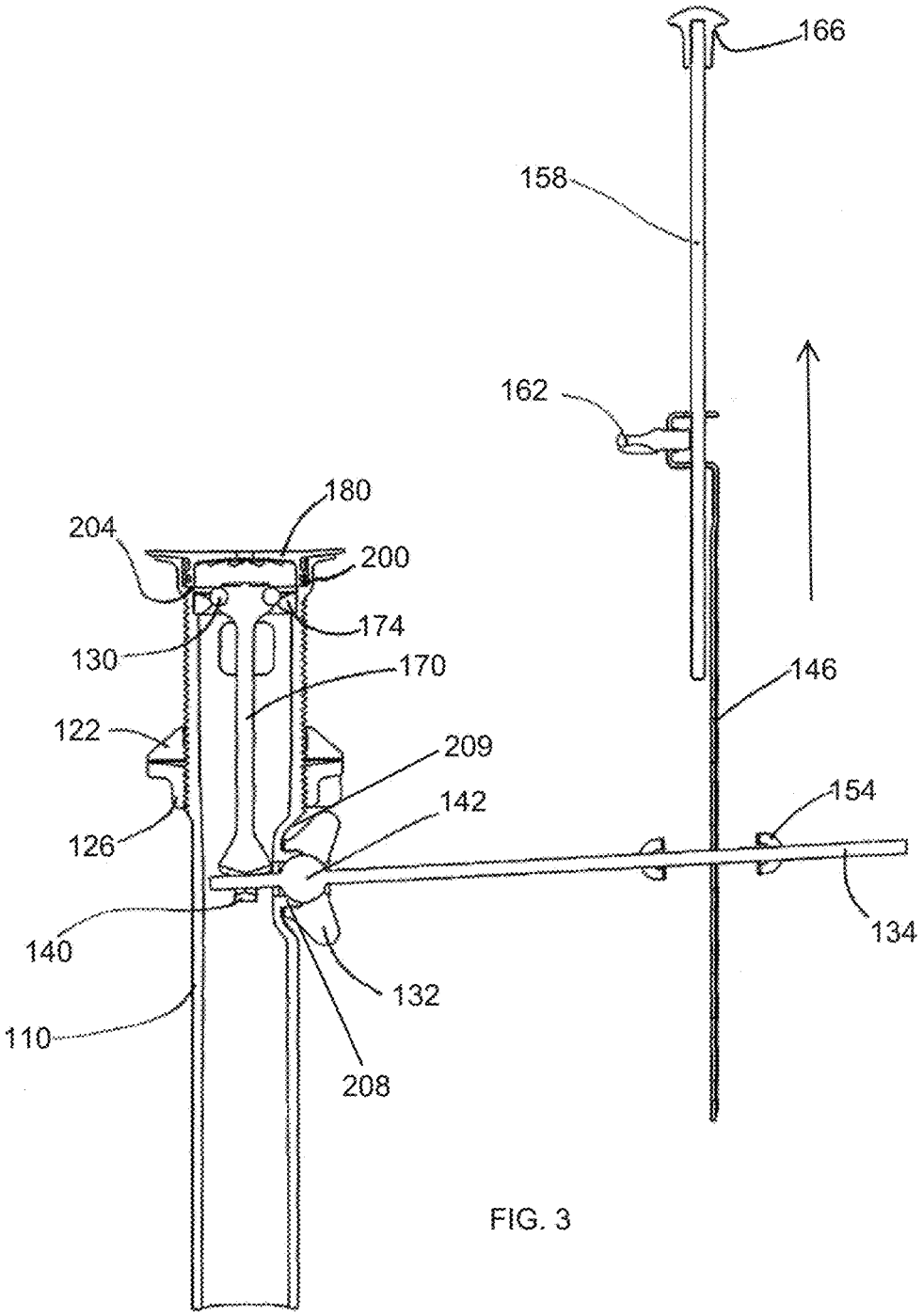
FIG. 3 is a cross-sectional view of FIG. 2 showing a stopper closed.
Figure 4:
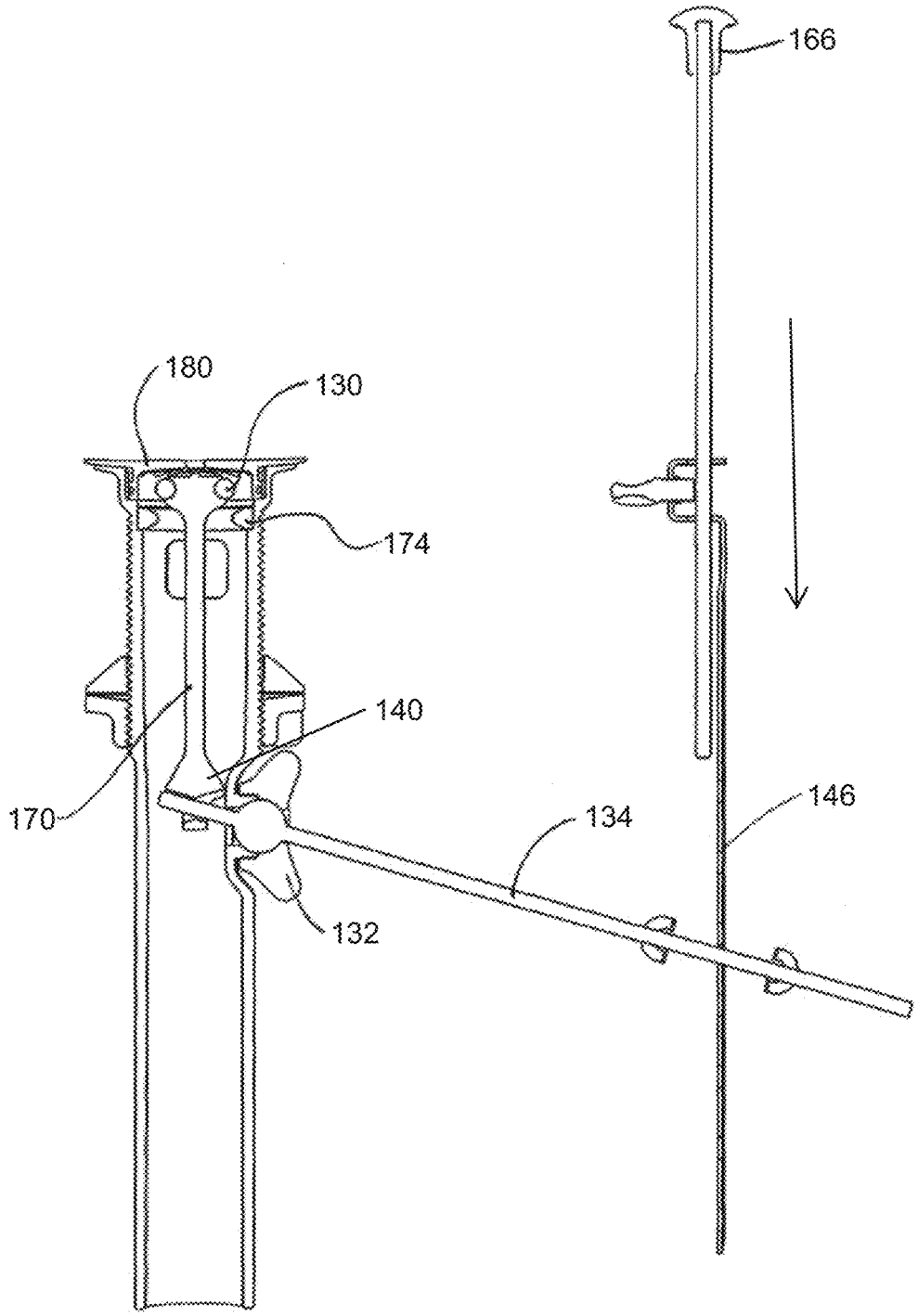
FIG. 4 is a cross-sectional view of FIG. 2 showing the stopper open.

The end of the ball rod 134 positioned in the body is interconnected to a distal end 140 of a valve stem 170. The distal end 140 of some embodiments is flared, or otherwise configured, to prevent hair and other debris from getting hung up on the ball rod 134 (see FIG. 4). The valve stem 170 also includes a proximal end comprised of a drain stopper 130. As shown in FIGS. 3 and 4, the drain stopper 130 cooperates with a seat 174 located within the body 110 to selectively allow fluid out of the sink.

The drain stopper 130, seat 174, etc. are concealed by an insert 180. The insert 180 includes an upper surface 184 with a plurality of holes 188 that allow water, but not large items from entering the drain plumbing. The insert has a wall 194 that accommodates a seal 192 that cooperates with an inner surface 196 of the body to secure the insert 180 the body 110. The wall 194 has a lower surface 200 that engages a shoulder 204 of the body 110 or the flange 114. Because the seal 192 does not permanently secure the insert 180 the body 110, if the insert becomes damaged, stained, or marred, or if the user wishes to change the aesthetic appearance of the sink, the insert 180 can be quickly removed and replaced without replacing the remainder of the wastewater system.

Figure 5A:
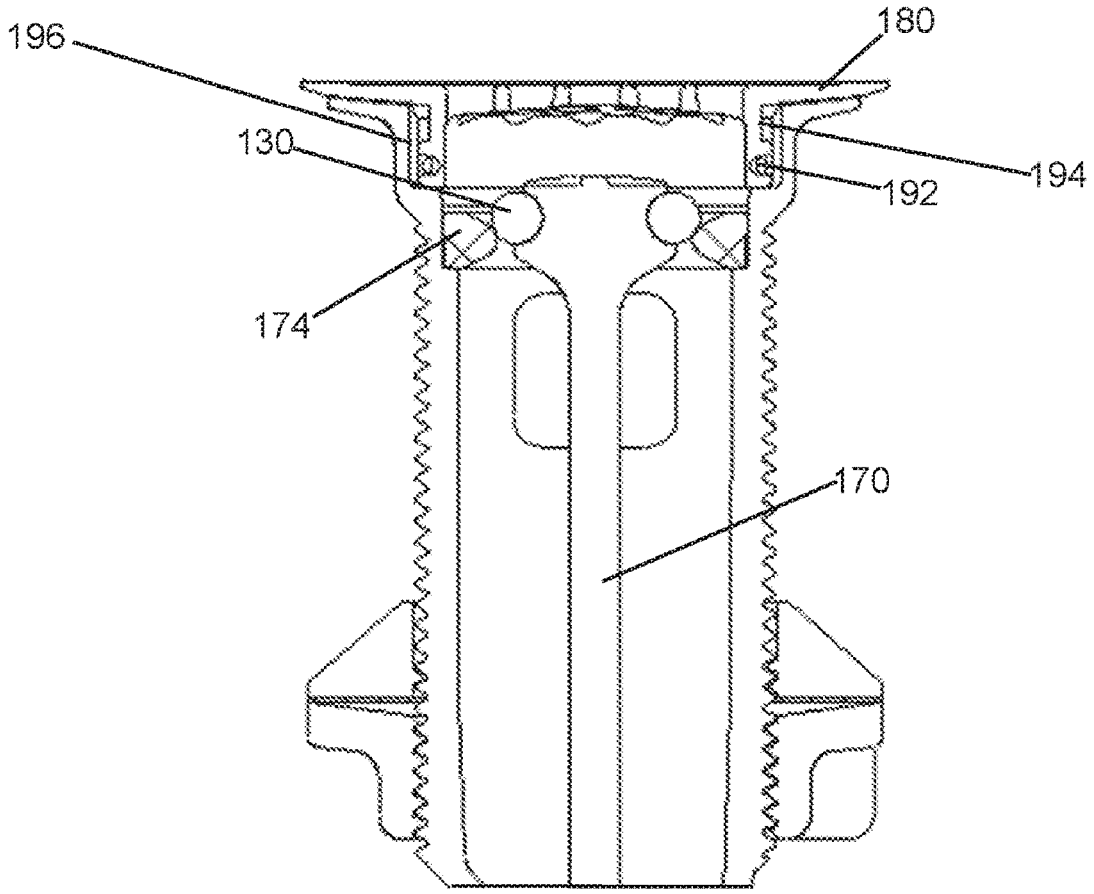
FIG. 5A is a detailed cross-sectional view showing the upper end of the embodiment shown in FIG. 2.

Again, the insert 180 of this embodiment of the present invention will selectively interconnects to a drain flange and associated drain plumbing by way of a seal 192 that selectively engages the inner surface 196 of the drain flange wall 206, i.e., an interference fit (see FIG. 5A). The seal 192 may fit within a groove integrated into the insert wall, or within outwardly extending protrusions on the insert wall. Also, multiple seals can be employed, and an enlarged seal may be employed. Those of ordinary skill in the art should appreciate that other interconnection methods or schemes are contemplated. For example, the interconnection methods described in U.S. Pat. Nos. 6,154,898, 7,503,083, 8,607,376, 9,015,870, 9,015,876, and insert interconnection methods similar thereto, may be used to selectively interconnect the insert 180 to the drain flange 114 without departing from the scope of the present invention. Furthermore, some embodiments the present invention: 1) do not employ a seal, and rely on adhesives to secure the flange to the drain flange; 2) do not employ an insert wall, wherein a circular plate is adhered or otherwise interconnected to the drain flange; 3) employ a flange with a downwardly-extending lip for selective engagement onto an outer edge of the drain flange; 4) employ a cylindrical insert wall that selectively engages seals or other interconnection device is associated with the sink strainer or drain plumbing; or 5) employ mating devices that selectively engage with corresponding mating features on the train strainer, i.e., a bayonet fitting or snap in connection.

Figure 5B:
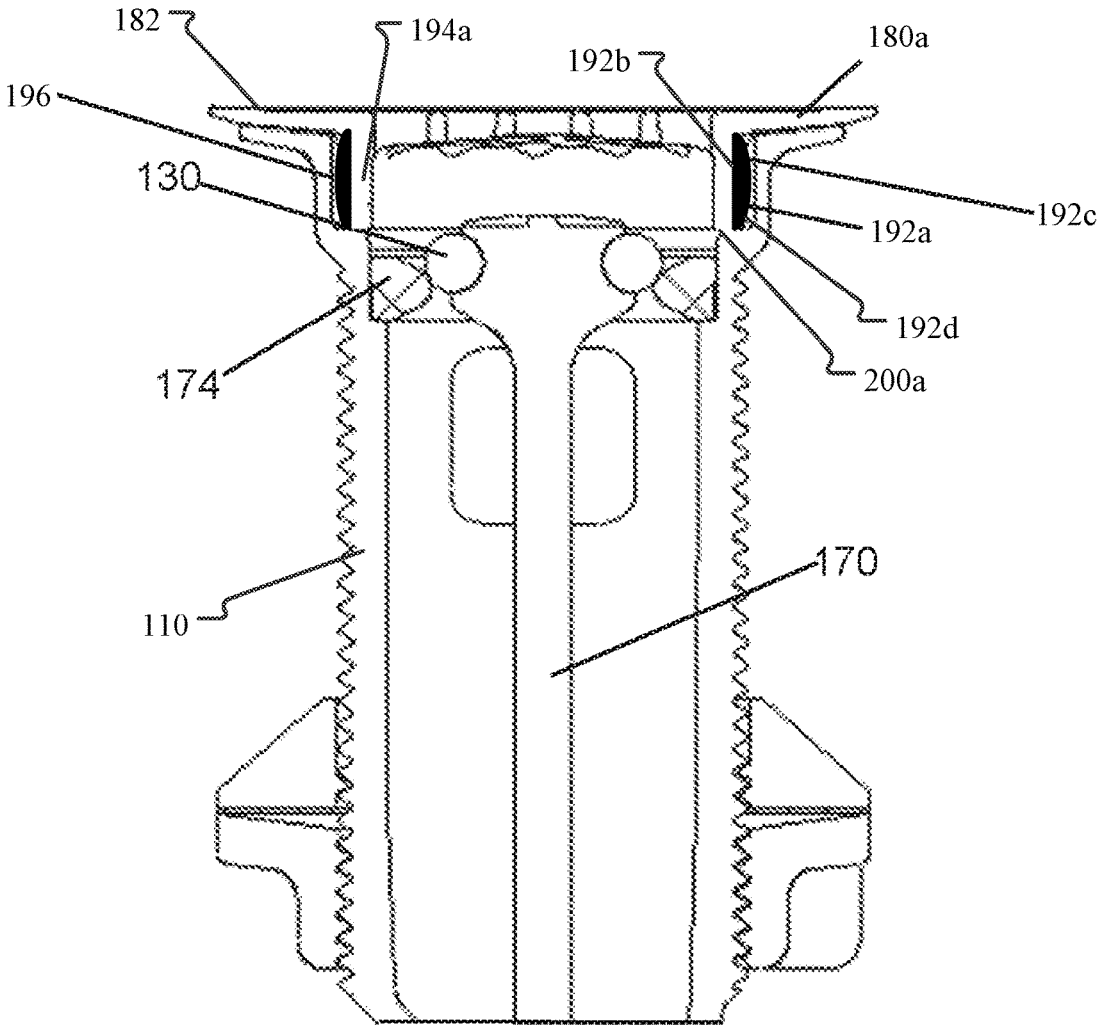
FIG. 5B is a detailed cross-sectional view showing another upper end of the embodiment shown in FIG. 2.

FIG. 5B shows another example of an insert 180*a* that may be selectively interconnected to a drain flange and associated drain plumbing. In this example, the insert 180*a* includes a wall 194*a* that is devoid of grooves or threads. The wall 194*a* accommodates a seal 192*a* that cooperates with the inner surface 196 of the body 110 to secure the insert 180*a* to the body 110. The seal 192*a* extends along the outer surface of the wall 194*a* from an insert flange 182 to a lower surface 200*a* of the wall 194*a*, and is formed from a resilient material. A cylindrical inner surface 192*b* of the seal 192*a* resiliently grips the wall 194*a* so as to secure the seal 192*a* to the insert 180*a*. The seal 192*a* also includes a proximal end 192*c* and a distal end 192*d*. One or both of the proximal end 192*c* and the distal end 192*d* may include a tapered surface. The seal 192*a* having a portion located between the proximal end 192*c* and the distal end 192*d* and above the tapered surfaces that is adapted to contact the inner surface 196 of the body 110. Additionally, when the seal 192*a* is installed, at least a portion of the proximal end 192*c* and the distal end 192*d* does not contact the body 110.

Figure 2:
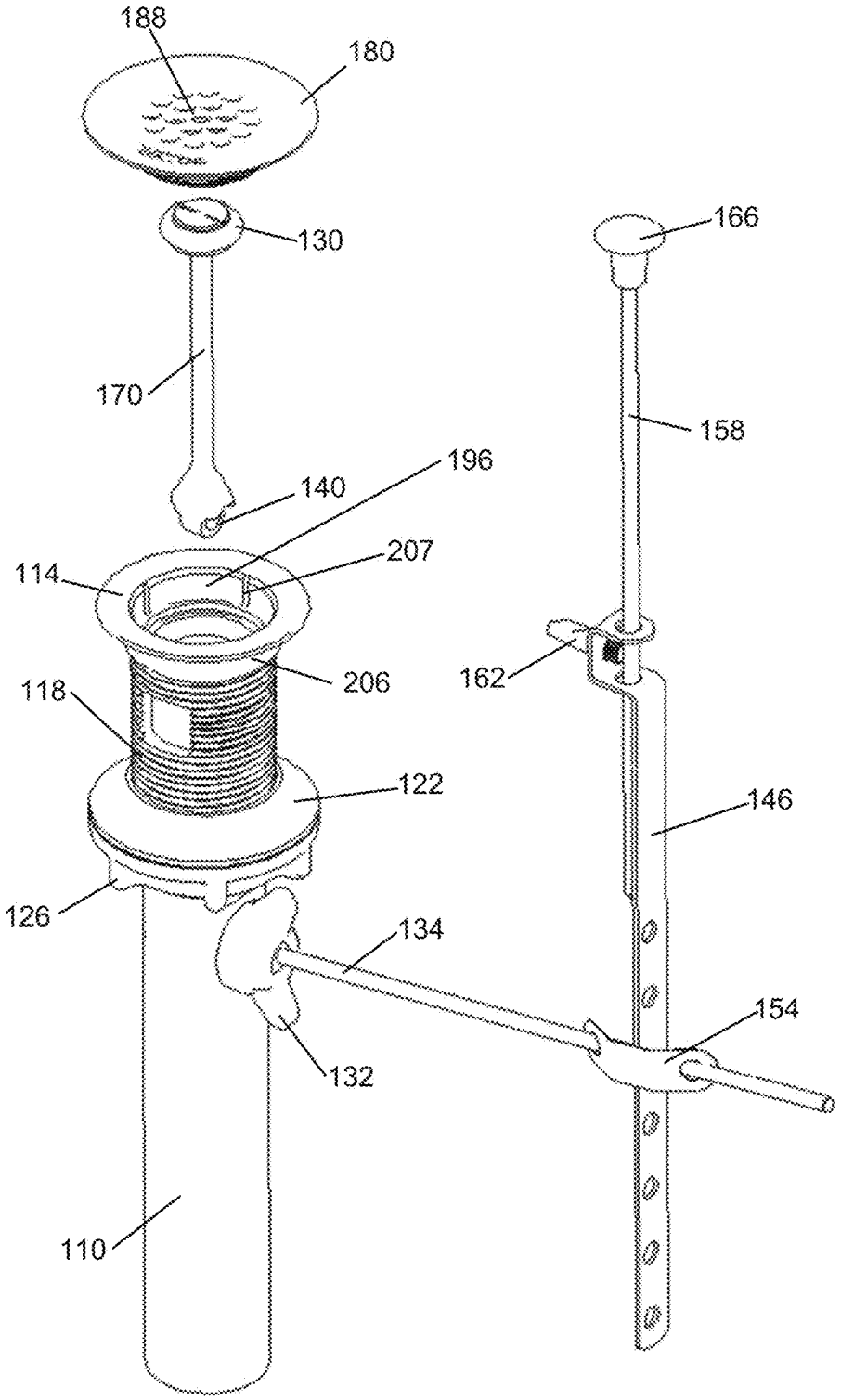
FIG. 2 is a perspective view of a drain closure system of one embodiment of the present invention.

FIG. 2 shows another feature of some embodiments of the present invention. As shown, the flange 114 is interconnected to the threaded portion 118 of the body by way of a cylindrical, semi-cylindrical, or conical wall 206 having the inner surface 196 described above. At least one groove 207 is provided in the wall 206. Water, which does not exit the sink via the openings 188 in the insert 180, can exit the sink through any gap between the insert flange 180 and the sink drain flange 114 and into the drain plumbing via the groove(s) 207.

As discussed above, FIGS. 3 and 5 show the wastewater drain with the drain stopper 130 in a closed position. Here the drain stopper 130 is abutted against the seat 174 which prevents fluid from entering the body 110. This configuration is achieved by pulling the knob 166 upwardly to move the attached rod 158 and link 146 upwardly. Movement of the rod 158 upwardly rotates the end of the ball rod 134 positioned within the body 110 about a ball 142 downwardly, which pulls a distal end 140 of the valve stem 170 downwardly.

FIG. 3 shows another feature provided by some embodiments of the present invention that facilitates installation. Here, a boss 208 that receives the nut 132 is positioned within a recess 209 that locates an outer surface of the boss 208 at a dimension equal to or less than the outer dimension of the body 110. This embodiment facilitates installation by allowing the body 110 to be dropped into the sink outlet. The nut 132 may have outer protrusions, i.e., wings, that facilitate tightening. In contrast, the prior art system shown in FIG. 1 has a larger boss, which does not fit through the drain outlet. To install the prior art system a plumber must position an upper edge of the body through the drain outlet and fasten the sink flange thereto. Then, the nut 22 is used to secure the body 10 to the sink 2. As those of ordinary skill in the art will appreciate, this is a two-hand or two-person operation.

FIG. 4 shows the wastewater drain system in an open position wherein the rod 158 has been pushed downwardly to rotate the end of the ball rod 134 upwardly to push the valve stem 170 upwardly, thereby moving the attached valve stem 170 away from the seat 174 to open the fluid flow path from the sink to the body 110.

Figure 6:
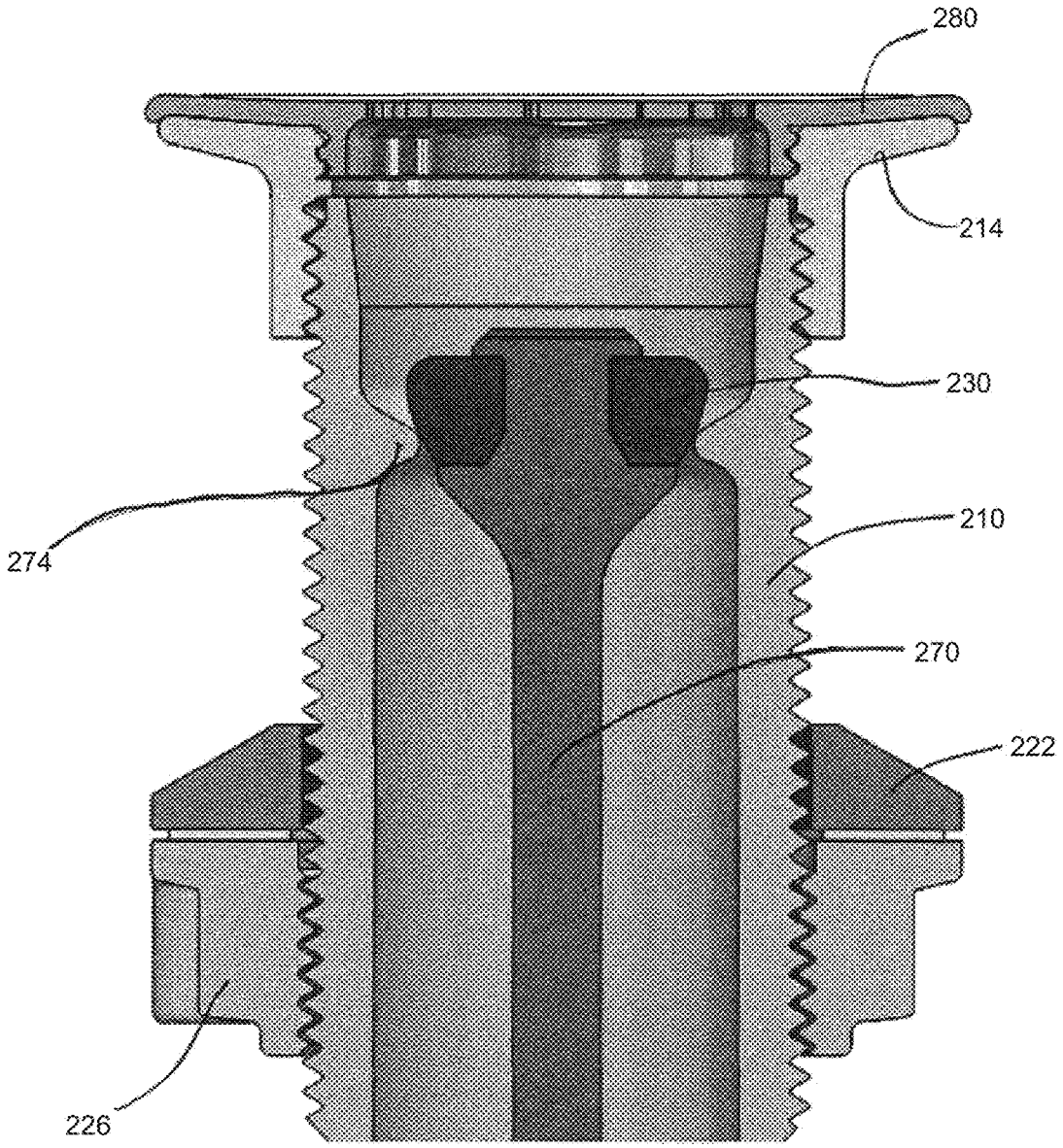
FIG. 6 is a cross-sectional view of another embodiment of the present invention that employs an insert having external threads.
Figure 7:
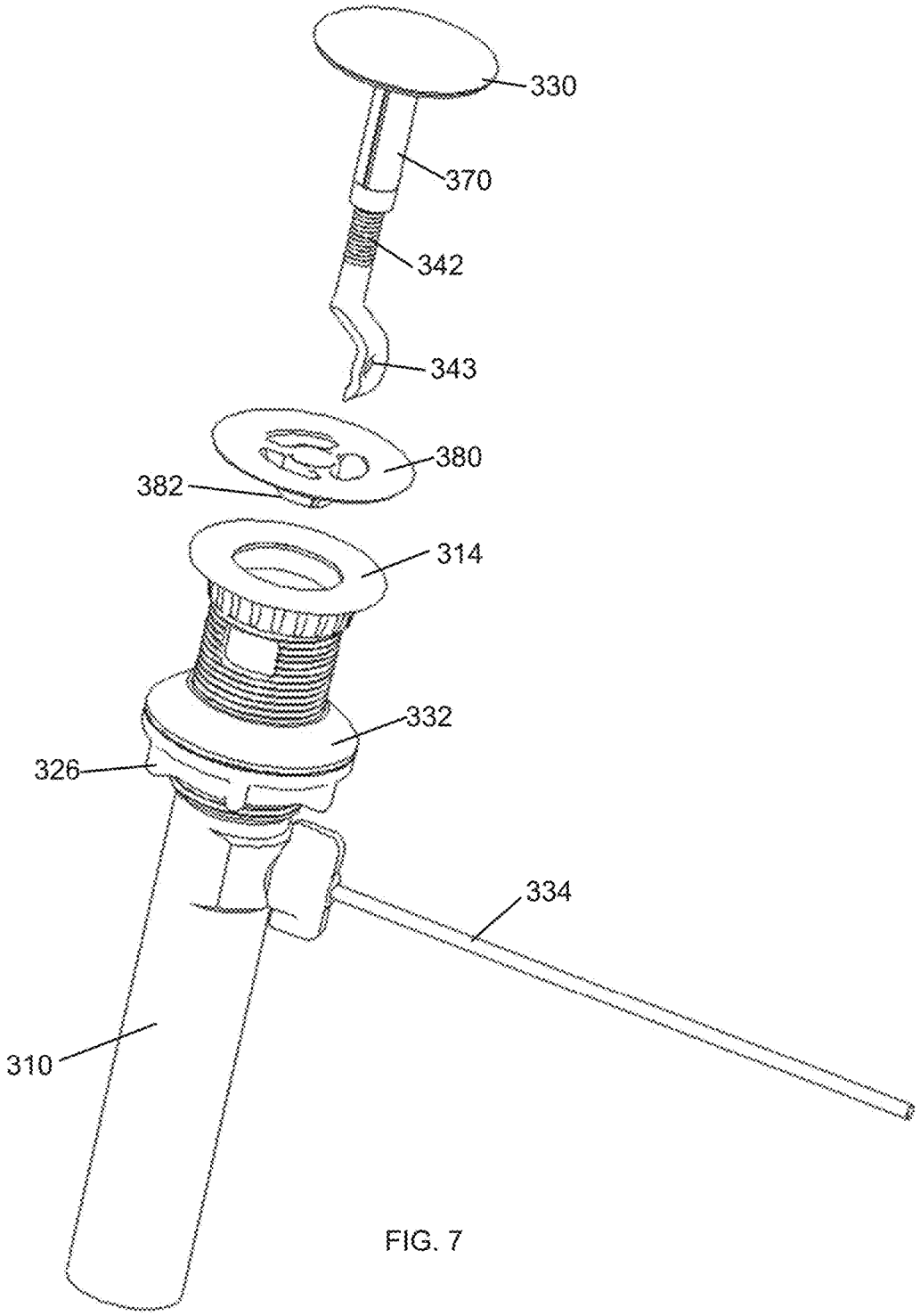
FIG. 7 is an exploded perspective view of another embodiment of the present invention that employs an external stopper.

FIG. 6 shows another embodiment of the present invention where the insert 280 is selectively interconnected to a sink flange 214. Other features of this embodiment are similar to those employed by the embodiments described above. FIG. 6 also shows that sink the flange 214 does not need to be integral to the body to 10, but may be threateningly engaged thereto. The remaining operation of this embodiment of the present invention is similar to or same as that described above, wherein a drain stopper 230, a valve stem 270, a seat 274, a seal 222, and a nut 226 are provided.

FIGS. 7-10 show another embodiment of the present invention wherein the drain stopper 330 is external to the body 310. Here, the drain stopper 330 comprises a downwardly-extending stem 370 and a threaded lower portion 342. The threaded portion 342 is operatively interconnected into the stem 370, thereby allowing the length between the stopper 330 and a distal end 340 to be altered if needed. The threaded portion 342 also includes an opening 343 for receipt of an end of the ball rod 334 positioned within the body 310. Here, the sink flange 314 is selectively interconnected to or integrated with the body 310.

Figure 8:
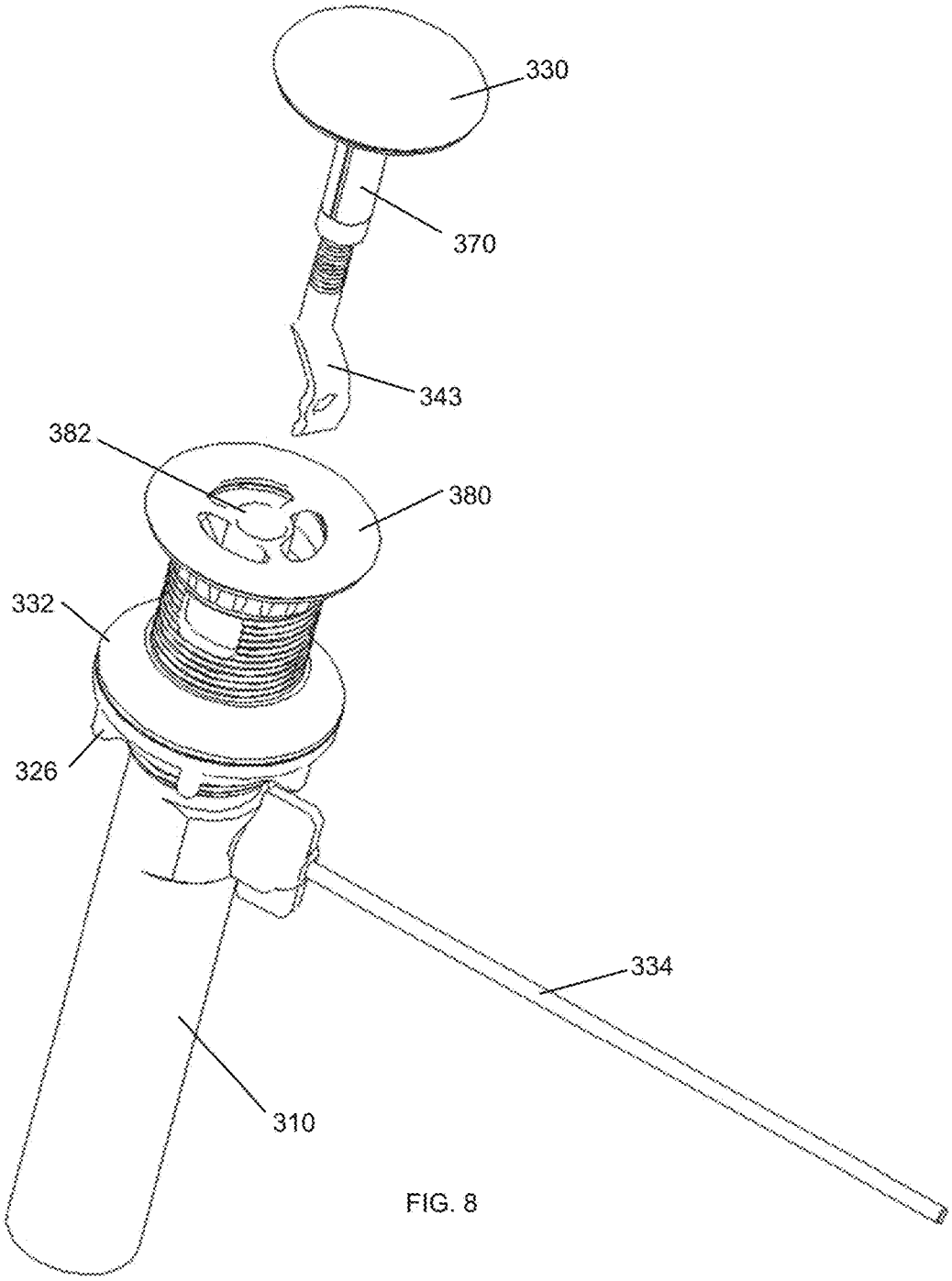
FIG. 8 is a top perspective view of the embodiment shown in FIG. 7.
Figure 9:
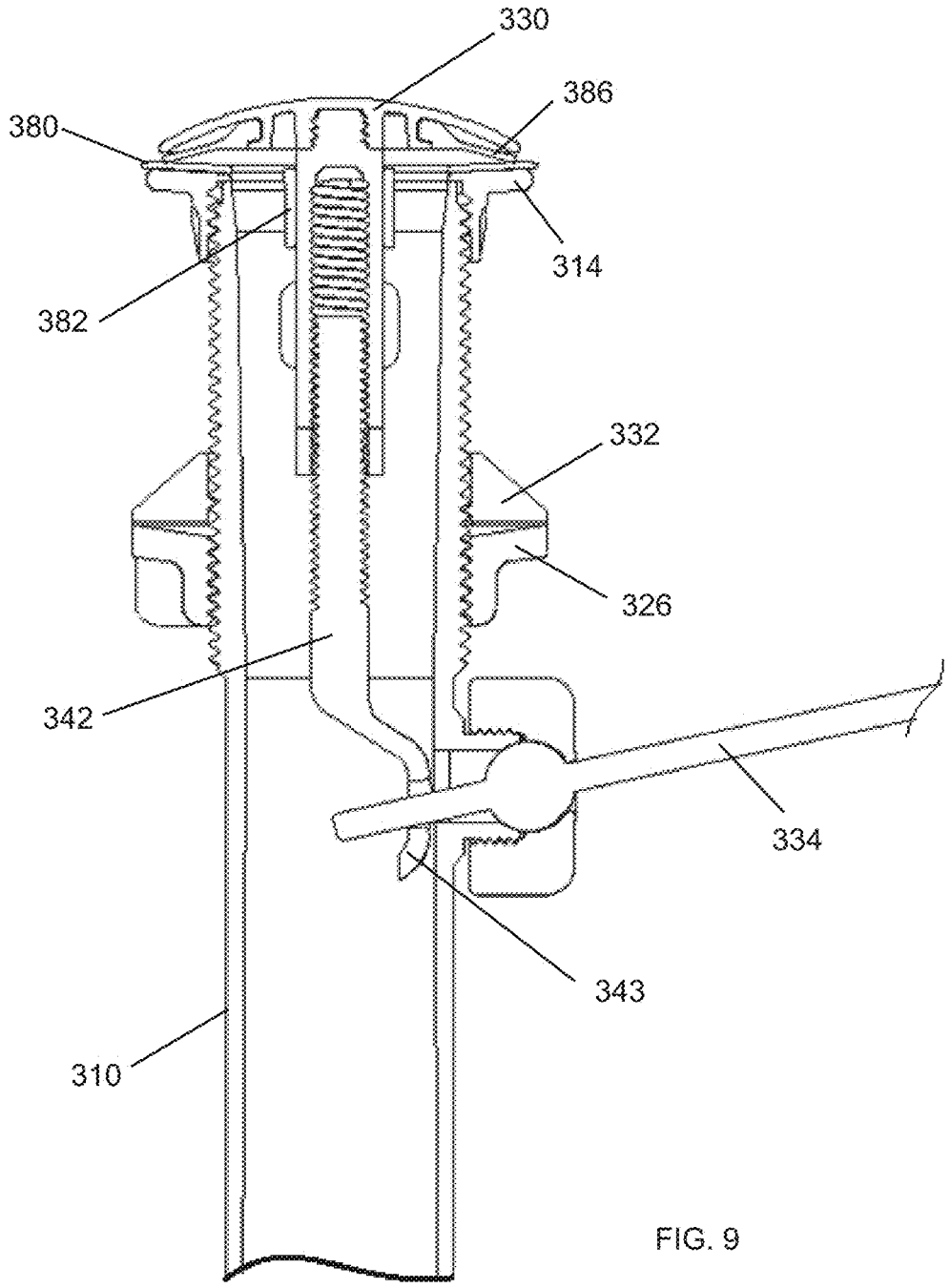
FIG. 9 is a cross-sectional view of FIG. 7.
Figure 10:
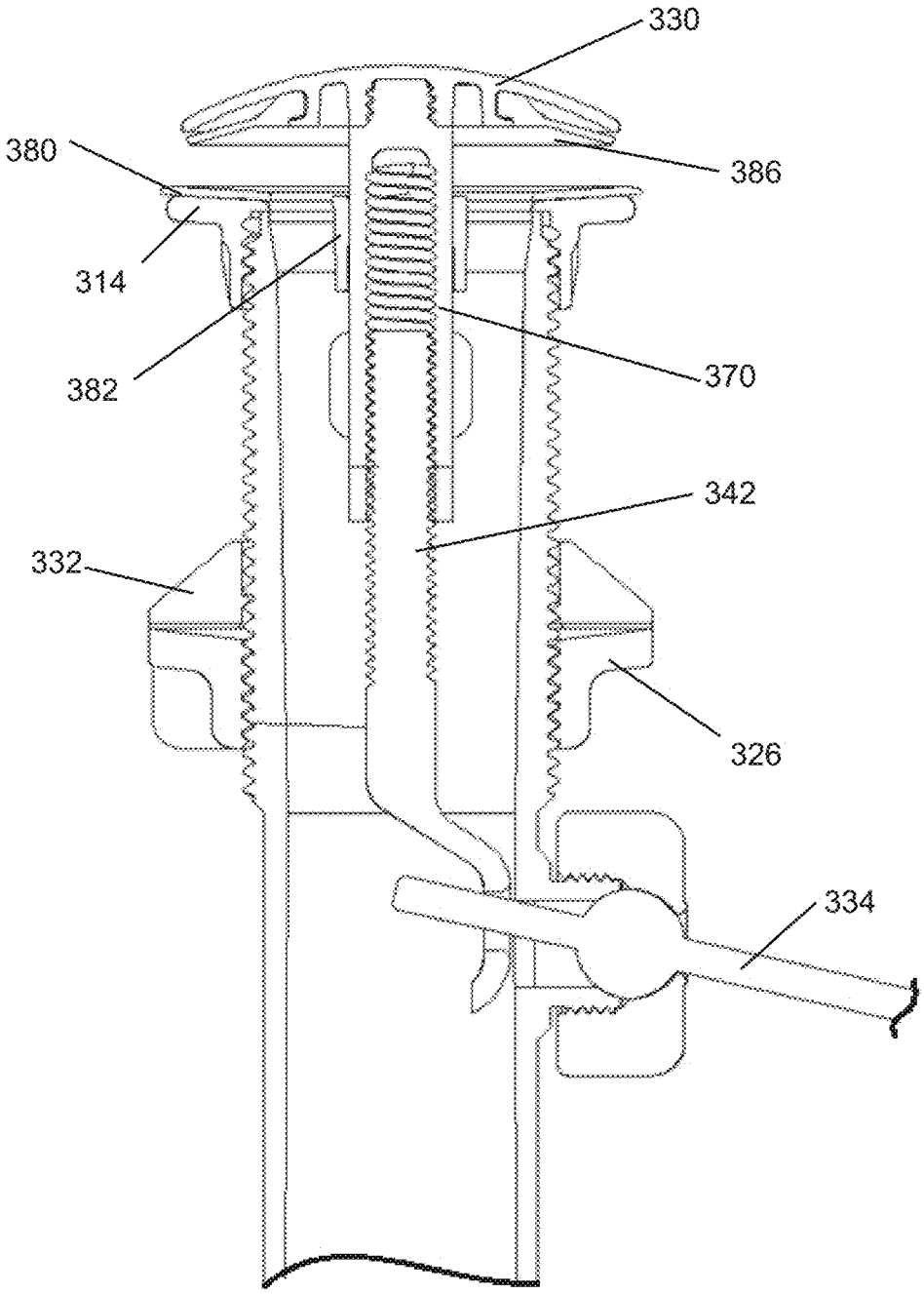
FIG. 10 is a cross-sectional view of FIG. 7, wherein the stopper is opened.

This embodiment also includes an insert 380 with a hub 382 that is attached, e.g., glued, to the flange 314. The insert 380 may also include a wall that selectively interconnects to the sink flange or body as is shown in the embodiments discussed above. The hub 382 provides a cylindrical opening for receipt and securement of the stem 370 as shown in FIGS. 8 and 9. Upon pulling a knob upwardly, (see FIG. 2, for example,) the stem 370 and threaded portion 342 are pulled downwardly, which pulls the stopper 330 and attached seal 386 into engagement with the insert 380 to close the body 310 to the flow.

The knob is pushed downwardly, the end of the ball rod 334 moves upwardly, which moves the stem 370 upwardly to separate the seal 386 from the insert 380 allow fluid to flow into the body.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A wastewater drain system, comprising:

a ball rod;

a body having a first end and a second end adapted for interconnection to a wastewater drain pipe, the body having an opening for receipt of the ball rod and a seat positioned within the body;

a flange interconnected to the first end of the body;

a shoulder positioned within the body and proximate the first end;

at least one groove defined in the body, wherein the at least one groove extends axially in a direction from the first end towards the shoulder;

a nut adapted to be abutted against an exterior of a fluid receptacle, wherein the flange is abutted against an interior of the fluid receptacle, and wherein the body is secured to the fluid receptacle by the flange and the nut;

a stem having a proximal end and a distal end, wherein the distal end is operatively interconnected to an end of the ball rod and the proximal end includes a stopper;

an insert selectively interconnectable to the first end of the body, the insert comprising an insert flange and an annular insert wall extending therefrom, wherein the insert wall has an annular lower surface that is configured to engage with the shoulder when the insert is interconnected to the body; and wherein the ball rod is configured to actuate the stem between a first position that engages the stopper against the seat preventing fluid flow through the body, and a second position that separates the stopper from the seat allowing fluid flow through the body.

2. The system of claim 1, wherein the first end of the body is threaded and the flange is threadingly interconnected to the body.

3. The system of claim 1, wherein the insert includes an upper surface comprised of a strainer.

4. The system of claim 1, wherein the insert flange comprises a lip around a periphery of the insert flange, the insert flange adapted for engagement with the flange, and wherein the insert wall comprises an outer surface of an outer diameter extending downwardly from the insert flange, the outer surface being spaced from an inner diameter of the flange.

5. The system of claim 1, wherein the insert wall is interconnected to an inner surface of at least one of the flange and the body with a seal member.

6. The system of claim 5, wherein the seal member is an o-ring.

7. The system of claim 5, wherein the seal member has a proximal end and a distal end made of a resilient material, the seal member also having a tapered surface at the distal end, the seal member extending along an outer surface of the insert wall from the insert flange to a lower portion of the insert wall, the seal member having a portion between the proximal end and the distal end and above the tapered surface that is adapted to contact the inner surface of at least one of the flange and the body, the seal member when installed does not contact at least one of the flange and the body at the proximal end and the distal end of the seal member.

8. The system of claim 7, wherein the seal member further comprises a tapered surface at the proximal end.

9. The system of claim 5, wherein the insert wall is devoid of grooves or threads, and wherein the seal member has a cylindrical inner surface that resiliently grips the insert wall.

10. The system of claim 5, wherein the insert flange includes a lip that is adapted to cover a portion of an outer edge of the flange.

11. A wastewater drain system interconnected to a sink drain port, comprising:

a body having a first, threaded end and a second end adapted for interconnection to a wastewater drain pipe, the body having an opening for receipt of a ball rod and a shoulder positioned within the body and proximate the first end, wherein the first end of the body comprises at least one groove defined therein, and wherein the at least one groove extends axially in a direction from the first end towards the shoulder;

a stem having a proximal end and a distal end, wherein the distal end is operatively interconnected to an end of the ball rod and the proximal end includes a stopper; and an insert associated with the drain port and selectively interconnectable to the body, the insert comprising an insert flange and an annular insert wall extending therefrom, wherein the insert wall has an annular lower surface that is configured to engage with the shoulder when the insert is interconnected to the body.

12. The system of claim 11, wherein the insert includes an upper surface comprised of a strainer.

13. The system of claim 11, wherein the insert flange comprises a lip around a periphery of the insert flange, the insert flange adapted for engagement with a portion of the body, and wherein the insert wall comprises an outer surface of an outer diameter extending downwardly from the insert flange, the outer surface being spaced from an inner diameter of the body.

14. The system of claim 11, wherein the insert wall is interconnected to an inner surface of the body with a seal member.

15. The system of claim 14, wherein the seal member is an o-ring.

16. The system of claim 14, wherein the seal member has a proximal end and a distal end made of a resilient material, the seal member also having a tapered surface at the distal end, the seal member extending along an outer surface of the insert wall from the insert flange to a lower portion of the insert wall, the seal member having a portion between the proximal end and the distal end and above the tapered surface that is adapted to contact the inner surface of the body, the seal member when installed does not contact the body at the proximal end and the distal end of the seal member.

17. The system of claim 16, wherein the seal member further comprises a tapered surface at the proximal end.

18. The system of claim 14, wherein the insert wall is devoid of grooves or threads, and wherein the seal member has a cylindrical inner surface that resiliently grips the insert wall.

19. The system of claim 14, wherein the insert flange includes a lip that is adapted to cover a portion of an outer edge of a flange of the body.

20. The system of claim 11, wherein the body comprises a boss that at least partially defines the opening that receives the ball rod, and wherein the boss is recessed within the body such that an outer surface of the boss is aligned with or below an outer diameter of the body.

* * * * *